United States Patent [19]

Radovan et al.

[11] 4,411,408

[45] Oct. 25, 1983

[54] JACK-UP PLATFORM APPARATUS

[75] Inventors: Felix S. Radovan, Cypress; Albert M. Koehler; Donald R. Ray, both of Houston, all of Tex.

[73] Assignee: The Offshore Company, Houston, Tex.

[21] Appl. No.: 446,574

[22] Filed: Dec. 3, 1982

Related U.S. Application Data

[63] Continuation of Ser. No. 134,012, Oct. 27, 1980, abandoned.

[51] Int. Cl.[3] ..... B66F 1/00

[52] U.S. Cl. ..... 254/108

[58] Field of Search ..... 254/89 H, 105–108; 405/201–203, 207–208

[56] References Cited

U.S. PATENT DOCUMENTS

| | | | |
|---|---|---|---|
| 2,540,679 | 2/1951 | Laffaille | 254/105 |
| 2,822,670 | 2/1958 | Suderow | 254/106 |
| 2,932,486 | 4/1960 | Suderow | 254/107 |
| 2,997,852 | 8/1961 | Suderow | 254/106 |
| 3,257,099 | 6/1966 | Merritt | 254/105 |
| 3,396,945 | 8/1968 | Schreier et al. | 254/106 |
| 3,565,400 | 2/1971 | Yamura | 254/106 |
| 3,804,369 | 4/1974 | Sutton | 254/105 |

FOREIGN PATENT DOCUMENTS 2422515 11/1974 Fed. Rep. of Germany ..... 254/106

*Primary Examiner*—Robert C. Watson

*Attorney, Agent, or Firm*—Bradford E. Kile

[57] ABSTRACT

A jack-up platform apparatus operable for effecting relative vertical motion between a leg chord of a platform and a deck of the platform.

The jack-up apparatus includes at least one generally rectangular reaction member operable to be connected at one end thereof to the platform deck in a posture contiguous to but spaced from a leg chord of the platform. An abutment member is connected to the other end of the reaction member and first and second leg chord engaging members are mounted for selective translation along the reaction member between the abutment member and the platform deck. A jack asembly is mounted between the first and second leg engaging members for translating the members along the reaction member wherein selective actuation of the first and second leg engaging members and the jack assembly will function to effect relative vertical motion between the platform leg chord and the platform deck while the reaction member reacts bending moments across the width thereof.

14 Claims, 15 Drawing Figures

JACKS UNDER LOAD

LOWERING LEG CHORD

JACKS UNDER NO LOAD

JACKS UNDER LOAD

LOWERING DECK

JACKS UNDER NO LOAD

JACKS UNDER LOAD

RAISING DECK

JACKS UNDER NO LOAD

JACKS UNDER LOAD

RAISING LEG CHORD

JACKS UNDER NO LOAD

JACK-UP PLATFORM APPARATUS

This is a continuation of application Ser. No. 06/134,012, filed on Oct. 27, 1980 now abandoned.

BACKGROUND OF THE INVENTION

This invention relates to a novel jack-up platform apparatus. More specifically, the subject invention relates to an offshore jack-up platform apparatus of the type utilized by the petroleum industry.

In the past, offshore platforms or towers have been extensively utilized around and upon the continental shelf regions of the world. Examples of offshore platform facilities include supports for radar stations, light beacons, scientific and exploration laboratories, chemical plants, power generating plants, mining stations, etc. Principally, however, offshore platforms have been utilized by the oil and gas industry in connection with drilling, production and/or distribution operations.

In conducting such offshore activity, several platform designs have been employed by the industry. In deep water applications, semi-submersibles or drillships, which are dynamically positioned and/or turret moored over a well site, have been effectively employed. Although semi-submersibles and drillships are highly mobile and widely utilized in deep water applications, the initial cost and subsequent operating expense reduces the desirability of such units for use in shallow water or intermediate depth applications.

In shallow water applications, fixed length towers or platforms have been extensively utilized. In this regard such platforms are fabricated on shore and transported in a generally horizontal posture to an offshore site upon a barge or buoyancy chambers within the platform legs. On site, the platform is pivoted into an upright posture and the base is positioned into firm engagement with the seabed. A platform deck is then fabricated upon the erected tower for conducting offshore operations. Such fixed platforms, although economical, require considerable time to assemble and once in position are difficult to relocate.

One platform design which combines many of the advantages of floating and fixed equipment is known as a "jack-up platform". In this connection a jack-up platform typically comprises a barge or self propelled deck operable to function in a conventional flotation capacity during transportation and in a working deck capacity on location. The deck is fitted with one or more legs which are operable to be vertically extended downward from the deck and into supporting engagement with the seabed.

In operation a jack-up platform is either towed or navigated to a desired offshore site with the jack-up legs extending through well fashioned through the deck. On site the legs are jacked downward into firm engagement with the water bed. Further jacking serves to raise the hull/deck with respect to the surface of the body of water. Once the lowermost portion of the deck is elevated above a statistical storm wave height, jacking is discontinued and drilling and/or production operations are begun from the elevated deck. Upon completion of the desired offshore operations, the deck is jacked down to the surface of the body of water and the legs are jacked up. The platform is then towed or navigated to another working station and the process is repeated. Because of its mobility and versatility, jack-up platforms have emerged as one of the most desirable forms of platform design in the industry.

The subject invention is specifically directed to a new jack-up method and apparatus operable for effecting relative vertical motion between a leg chord and a deck or hull of a jack-up platform.

In the past, various designs have been at least theorized to jack supporting legs with respect to a deck of a jack-up platform. One such design comprises a rack and pinion assembly wherein a rack is welded along the length of each platform leg. Pinion gears are then either hydraulically or electrically driven from assemblies mounted upon the platform deck to raise and lower the legs. Another design utilizes pneumatic collars which operably surround and selectively engage the platform legs. Jack units cooperate with the pneumatic collars to effect vertical relative movement of the legs with respect to the deck.

One of the most popular designs comprises various modifications of a hydraulic piston and cylinder arrangement operable to act between a platform deck and adjacent supporting legs. Initial hydraulic designs, however, tended to be heavy, bulky structures requiring a number of closely fitting parts and guide members between the platform legs and the jacking assemblies. These members were subject to misalignment and jamming tendencies during operation. In addition to structural complexities and inefficiencies, early hydraulic designs often fixedly mounted one end of the hydraulic lifting assemblies to a deck frame. This design thus required the unit to work under load in both directions and tended to limit the jack capacity during the stroke which included the piston rod.

One system which has achieved a considerable degree of commercial success is disclosed in a United States Richardson U.S. Pat. No. 3,412,981 of common assignment with the instant application. In accordance with the Richardson invention, first and second yokes are mounted about a platform leg chord and are spaced by hydraulic jack cylinders mounted at the ends of the yoke legs. The yoke and hydraulic jacking assemblies float within a jack housing mounted upon the deck and function as more specifically disclosed in the patent specification to raise and lower the leg chord with respect to the jack housing and deck.

Although this previously known Richardson structure has achieved a significant degree of acceptance, it would be desirable to provide a jack-up method and apparatus wherein the size and weight of the jack-up apparatus may be reduced. In this regard, the jack housing and yoke must be sized to carry reaction moments during a jacking operation and thus represent a considerable weight factor relative to the overall platform design. Additionally, it would be desirable to provide a jack-up apparatus wherein the jacking assemblies would admit to prepackage fabrication and testing techniques and convenient final installation and assembly. In a similar vein, it would be highly desirable to provide a jack-up apparatus which would be operably releasable from a platform deck such that individual units might be interchangable or removable as needed or desired. Yet further it would be desirable to provide a novel jack-up method and apparatus wherein reaction moments created between an off-shore platform leg chord and pin assemblies extending between the leg chord and the jacking apparatus might be efficiently reacted.

The difficulties and/or limitations suggested in the preceding are not intended to be exhaustive, but rather are among many which may tend to reduce the effectiveness of prior jack-up methods and apparatus. Other noteworthy problems may also exist; however, those presented above should be sufficient to demonstrate that methods and apparatus appearing in the past for raising and lowering leg chords on jack-up platforms will admit to worthwhile improvement.

OBJECTS OF THE INVENTION

It is therefore a general object of the invention to provide a novel jack-up platform apparatus which will obviate or minimize the disadvantages, while advantageously achieving at least some of the desirable results, previously described.

It is a specific object of the invention to provide a novel jack-up platform apparatus wherein the weight of the operative jack-up structure is minimized.

It is another object of the invention to provide a novel jack-up apparatus which may be advantageously fabricated, pretested and prepackaged at a site which may be remote from overall platform fabrication facilities.

It is a further object of the invention to provide a novel jack-up apparatus wherein the jack-up apparatus may be universal and facilely removed from a platform and replaced in the event of wear and/or damage of a particular jack-up unit.

It is a related object of the invention to provide a novel jack-up apparatus wherein jack-up assemblies may be facilely removed from one platform and utilized on other platforms as desired.

It is a further object of the invention to provide a novel jack-up platform apparatus wherein jack-up assemblies operate, under load, is a push cycle thus minimizing the size and weight of jacks needed for a given load.

It is yet another object of the invention to provide a novel jack-up apparatus wherein reaction moments between a platform leg chord and a jack-up assembly are advantageously reacted.

It is a related object of the invention to provide a novel jack-up apparatus wherein the structural relationship of members which react bending moments between a deck and a leg chord of the platform are optimized.

It is still a further object of the invention to provide a novel jack-up apparatus wherein a jack-up assembly will be provided which is rugged yet streamlined in design and capable of achieving the desired jack-up functions while minimizing the weight and the number of separate moving and/or intricate character of elements comprising the jack-up system.

It is yet still a further object of the invention to provide a novel jack-up apparatus wherein hull space needed for the jack-up assemblies is minimized.

BRIEF SUMMARY OF A PREFERRED EMBODIMENT OF THE INVENTION

A preferred embodiment of the invention which is intended to accomplish at least some of the foregoing objects comprises a jack-up apparatus which includes at least one reaction member operably connectable at one end to a platform deck in a posture contiguous to but spaced from a leg chord of the platform. An abutment is provided at the other end of the at least one reaction member and first and second leg chord engaging members are mounted for selective translation along the reaction member. A jack mechanism is connected between the first and second leg engaging members and serves to translate said members between the abutment and the deck of the platform. Selective actuation of the first and second leg engaging members and the jack mechanism will function to effect relative vertical motion between the leg chord and the platform deck.

The method includes the steps of raising or lowering a platform deck with respect to a leg chord of the platform wherein first and second leg engaging members are selectively translated along a reaction member connected to the platform deck. Moments between the first and second leg chord engaging members and the leg chord are advantageously reacted by the reaction member positioned adjacent the leg chord of the platform.

THE DRAWINGS

Other objects and advantages of the present invention will become apparent from the following detailed description of a preferred embodiment thereof taken in conjunction with the accompanying drawings, wherein.

Figure 8A:
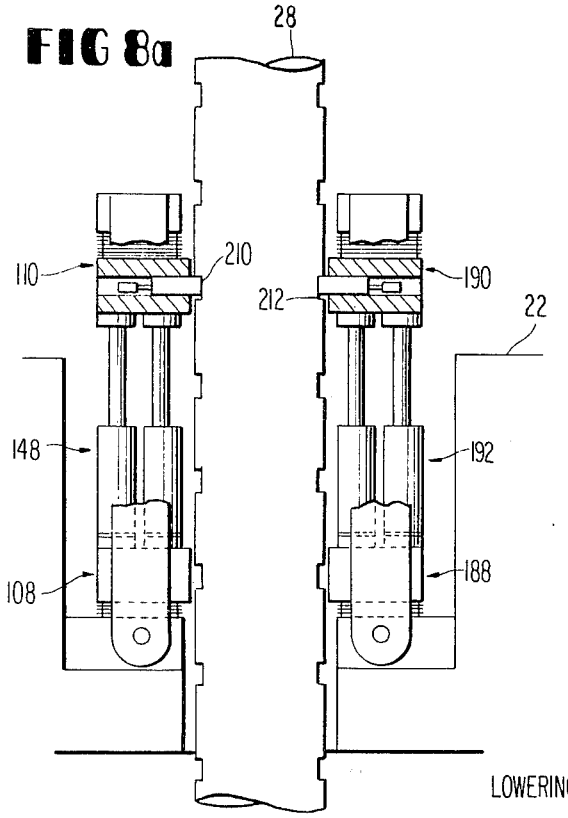
Figure 8B:
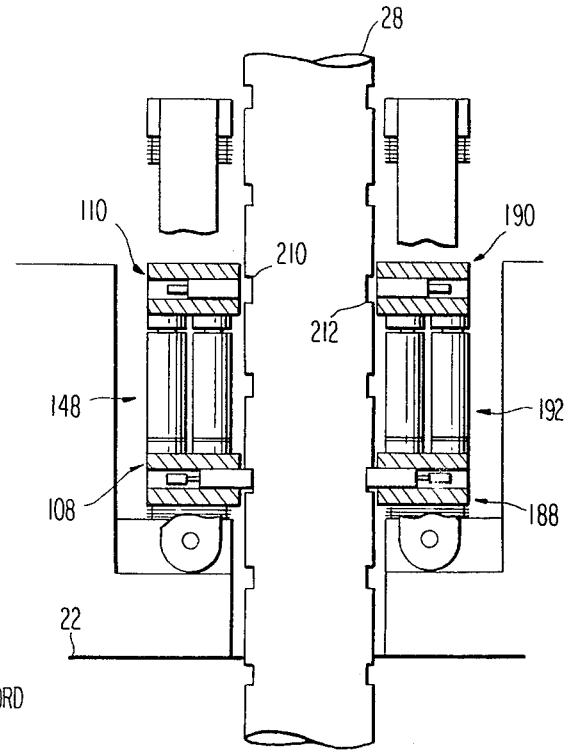
Figure 10A:
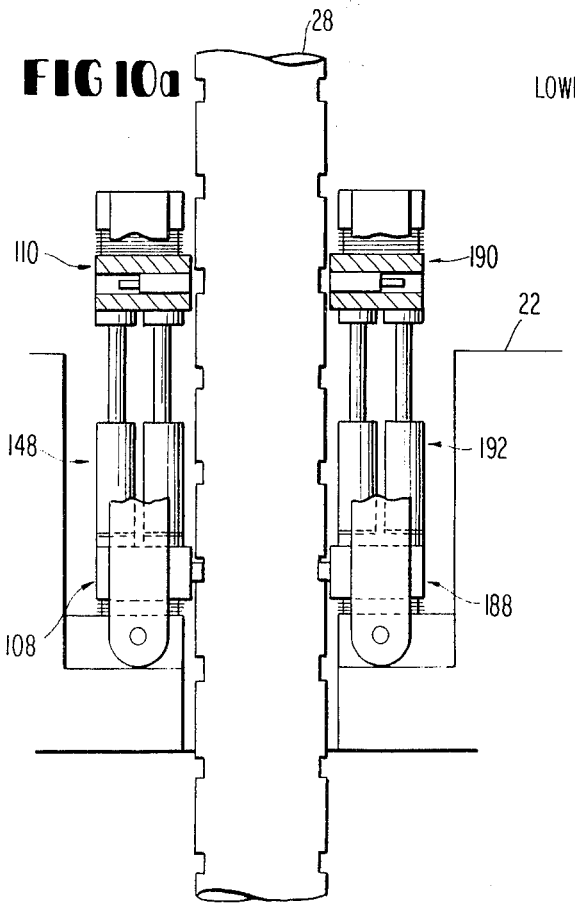
Figure 10B:
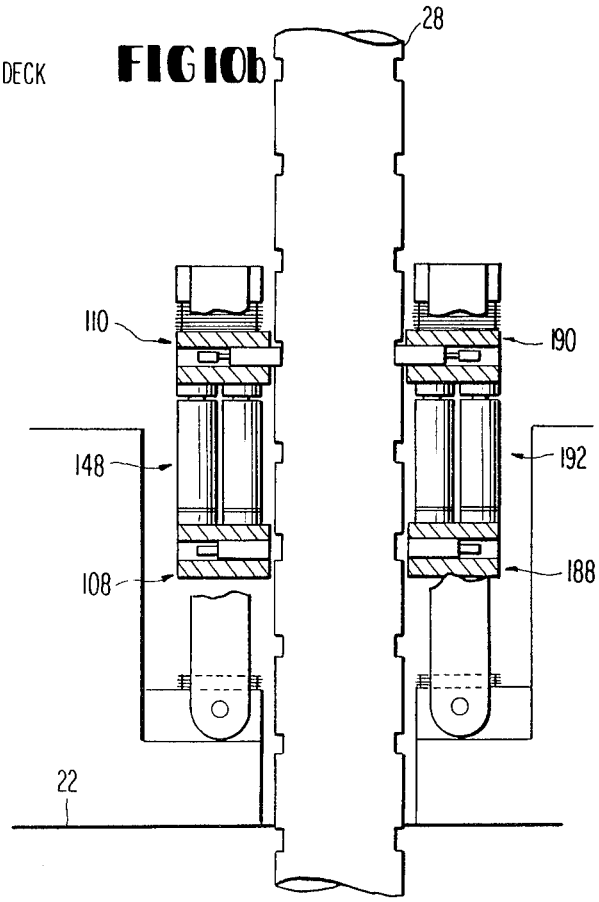
Figure 9A:
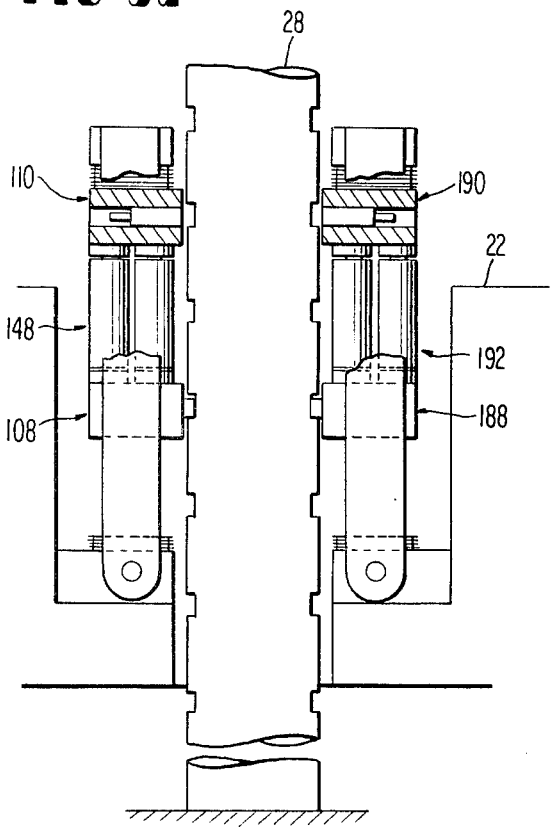
Figure 9B:
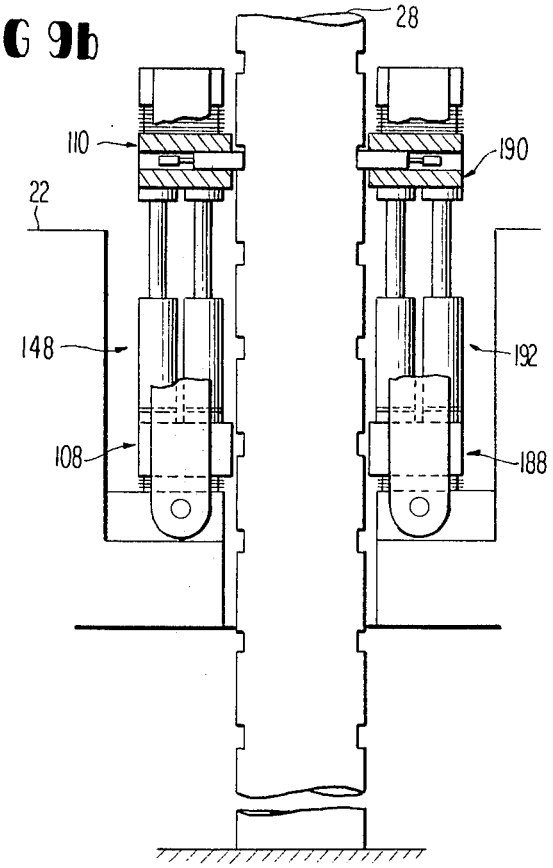
Figure 11A:
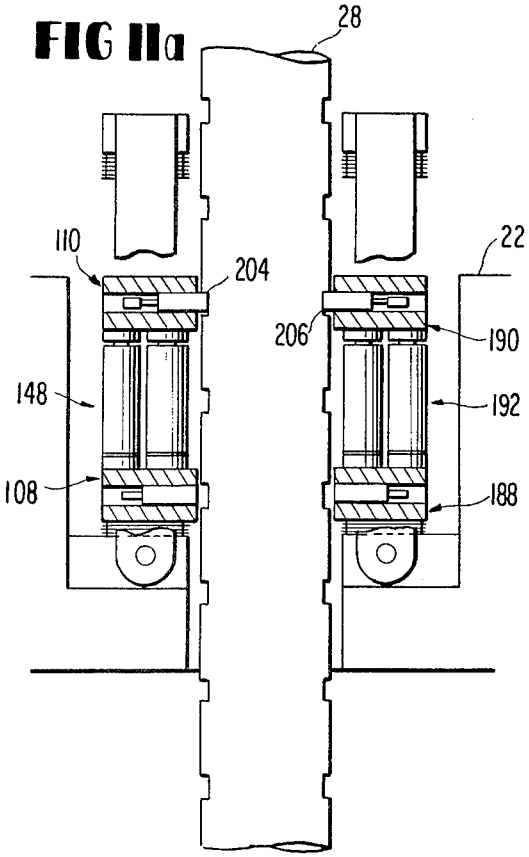
Figure 11B:
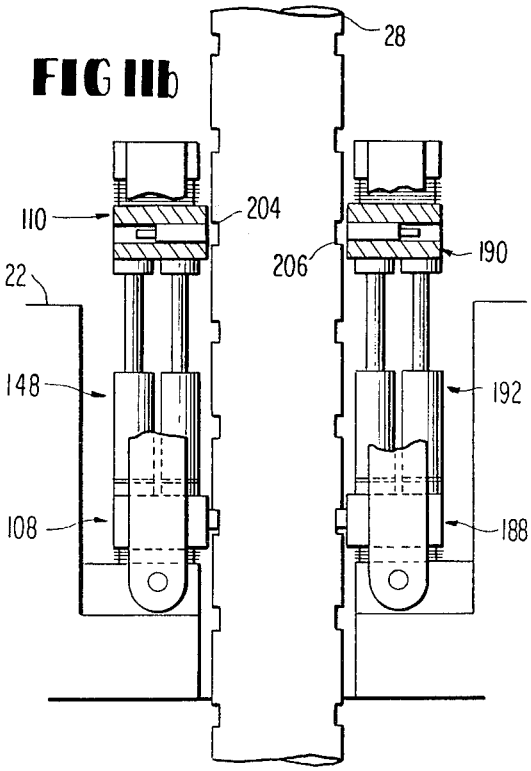

FIGS. 8*a–b* disclose a schematic operating sequence for lowering a leg chord of an offshore jack-up platform;

FIGS. 9*a–b*, note sheet 5, discloses a schematic operating sequence for raising a platform deck with respect to a leg chord of the offshore platform;

FIGS. 10*a–b*, note sheet 4, discloses a schematic sequence for lowering a deck with respect to a leg chord in preparation for moving the offshore platform to another working site; and FIGS. 11*a–b*, note sheet 5 again, discloses a further schematic sequence for raising a leg chord with respect to a deck for transportation of the jack-up platform to another working site.

DETAILED DESCRIPTION

Figure 2:
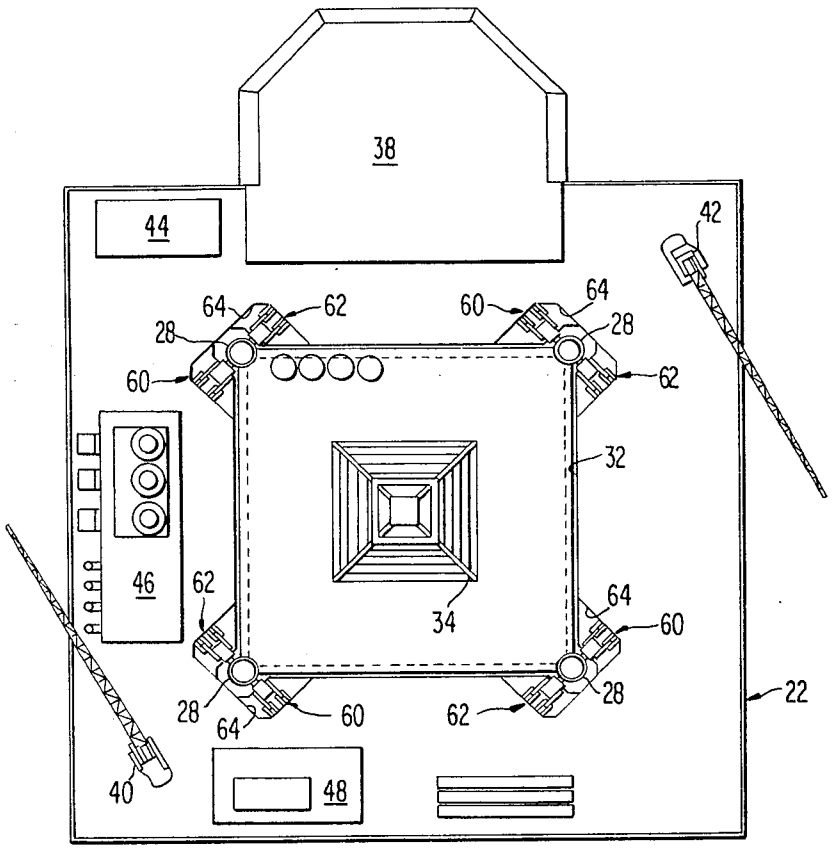
FIG. 2 is a plan view of the deck of the platform depicted in FIG. 1 wherein a plurality of jack-up assemblies are installed within deck wells for jacking engagement at diametrically opposed locations with a plurality of leg chords.
Figure 1:
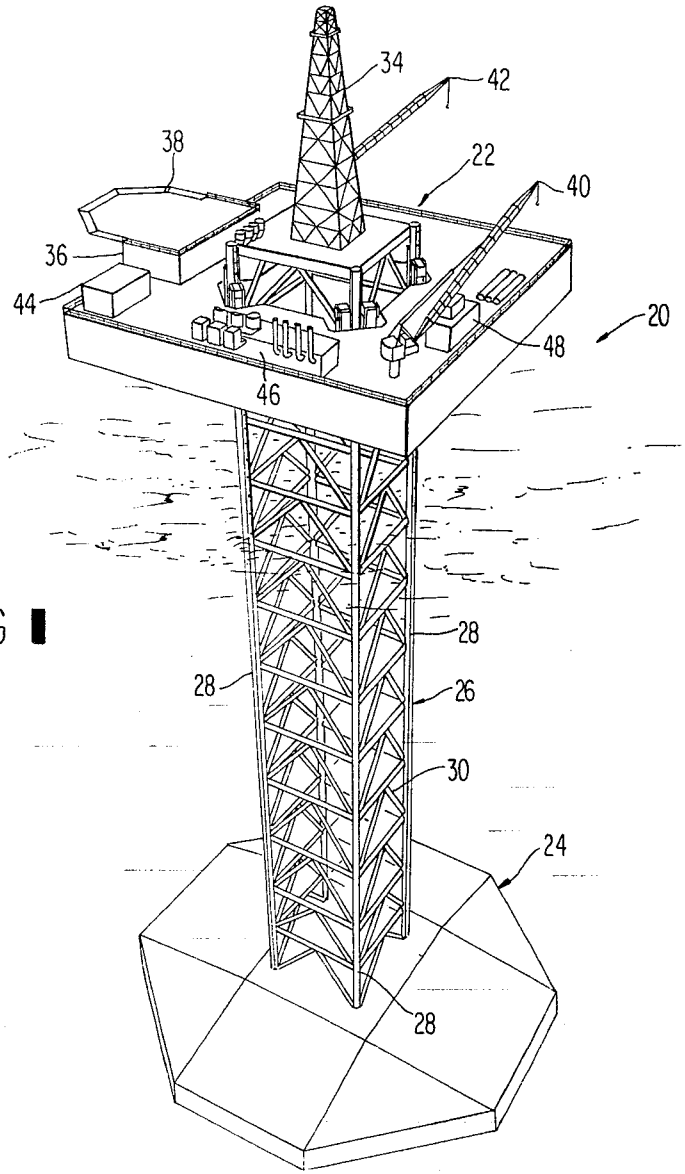
FIG. 1 is an axonometric view of a jack-up platform including jack-up assemblies in accordance with a preferred embodiment of the invention.

Referring now to FIGS. 1 and 2, wherein like numerals designate like parts, an offshore platform 20 is disclosed of the type which may advantageously utilize a jack-up method and apparatus in accordance with the present invention.

In general terms, the platform 20 comprises a deck 22, a base 24 and an inter-connecting leg 26. The base 24 is primarily designed to operably engage with the seabed to provide a footing or foundation for the platform. Additionally ballast chambers within the base 24 are evacuated during transportation and the base functions to provide buoyant support for the platform. The platform leg 26 is composed of a plurality of generally vertical chords 28 and an interconnecting bracing network 30 which is typically composed of "K" or "X" type bracing to unify the chords into a single leg. The leg 26 extends upwardly from the base 24 and projects through a wall 32 formed within the deck. The deck 22 is fitted with drilling and/or production equipment consistent with the intended offshore operation which may include, for example, a derrick 34, draw works, pipe racks and mud processing units, etc. The deck may also be provided with crew quarters 36 and a heliport 38 as well as general purpose cranes 40 and 42. Still further the deck may carry various units 44, 46 and 48 containing generators, compressors, separating and processing equipment, etc. of the type used in drilling and/or production activity.

A plurality of jack-up assemblies 60 and 62 in accordance with a preferred embodiment of the invention are located at diametrically opposing positions adjacent each of the chords 28 of the leg assembly 26. These units operably serve to selectively effect relative vertical motion between the leg chords 28 and the platform deck 22. More specifically in this connection, the base 24 and deck 22 are positioned closely adjacent to one another during transportation with the leg 26 projecting through the well 32 in the deck. In this posture, the platform is either towed or self-propelled to a working site. Ballast is then added to the base and the jack-up assemblies 60 and 62 are actuated to lower the base 24 and leg 26 relative to the deck 22 until the base is in firm engagement with the bed of the body of water. Further jacking serves to raise the deck with respect to the leg 26 to a desired elevation in excess of the crest of a statistical storm wave whereupon jacking operations are terminated and drilling and/or production is begun.

Upon completion of the drilling and/or production activity, the deck 22 is lowered or jacked downwardly with respect to the leg 26 until it again is floating upon the water surface. Further jacking serves to raise the base 24 and leg 26 upwardly until the original transportation position is achieved. At this point, the platform is either towed or self propelled to another working site.

Although FIGS. 1 and 2 of the drawings and the above general description and sequence of operation relate to a single leg jack-up platform wherein a leg assembly 26 projects through the center of a platform deck, the subject jack-up method and apparatus may also be advantageously utilized with multiple leg jack-up rigs such as depicted for example in a United States Moore et al. U.S. Pat. No. 3,628,336, or a United States Pease et al. U.S. Pat. No. 3,805,725, both of common assignment with the subject application.

Jack-Up Apparatus

Referring now specifically to FIGS. 3–7, there will be seen detailed views of jack-up assemblies 60 and 62 in accordance with a preferred embodiment of the invention. As specifically shown in FIG. 3, and as previously noted in FIG. 2, the jack-up assemblies 60 and 62 are mounted within deck wells 64 and extend upon diametrically opposite sides of a leg chord 28.

The jack-up apparatus 60 comprises first 66 and second 68 reaction members which are releasably connected to the base of the well 64 fashioned within the surface of deck 22. In this regard, first 70 and second 72 mounting brackets are united with the floor of the well and project in a generally parallel posture along a base member 74 (note FIGS. 3 and 5). One end of each reaction member 66 and 68 extends between the base member 74 and a respective mounting bracket and is releasably connected to the deck by pins 76 and 78 respectively.

Figure 3:
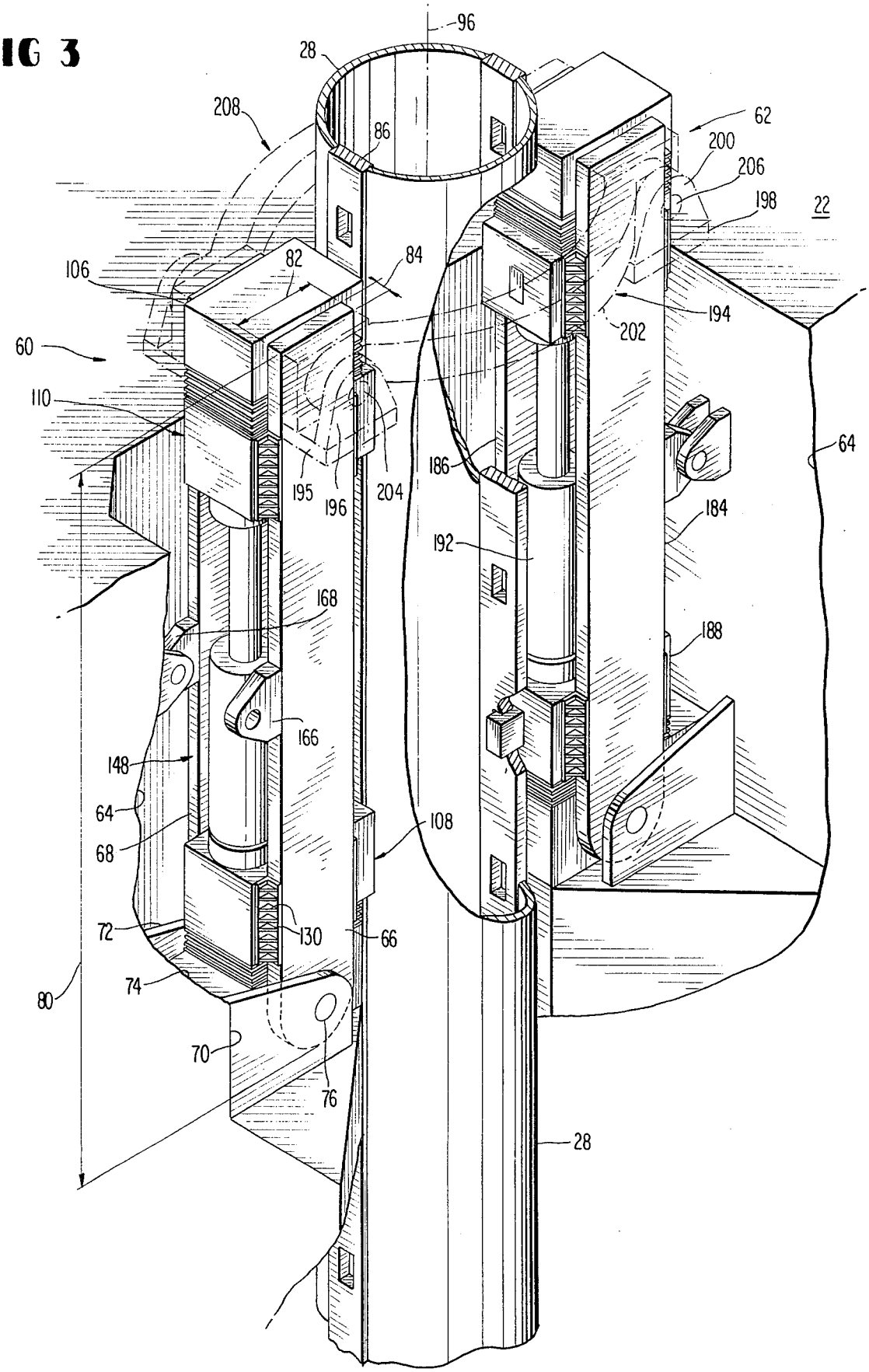
FIG. 3 is an axonometric view, partially broken away to disclose structural detail, of jack-up assemblies in accordance with a preferred embodiment of the invention.

The reaction members 66 and 68 are each generally elongated and rectangular and in a preferred embodiment consist of a solid rectangular slab of steel having height, width and depth dimensions 80, 82 and 84 respectively (note FIG. 3). These reaction members 66 and 68 extend in a generally upright manner in a posture contiguous to but spaced from a rail 86 or other connecting assembly known in the art which extends laterally along the jacking length of the leg chord 28.

The generally solid rectangular reaction members 66 and 68 are operably mounted upon the deck 22 of the platform such that imaginary planes 90 and 92 (note FIG. 5), extending through the edges of the reaction members defining the height and width dimensions thereof, extend parallel with an imaginary plane 94 intersecting a central longitudinal axis 96 of the leg chord 28 and a central portion of rail 86. In a similar vein imaginary planes 98 and 100 (note FIG. 4) passing through side surfaces 102 and 104 of the reaction members, across the width thereof, lie perpendicular to imaginary plane 94.

An abutment member 106 is mounted at the other end of the reaction members and is preferably a solid rectangular block which is unified to the reaction members by welding or the like.

A first leg engaging assembly 108 is mounted for translation along and between the reaction members 66 and 68 generally at the one end thereof as disclosed in FIG. 3. In a similar manner, a second leg engaging member 110 is mounted between the reaction members 66 and 68 for translation along and between the reaction members generally at the other end of the reaction members.

Figure 4:
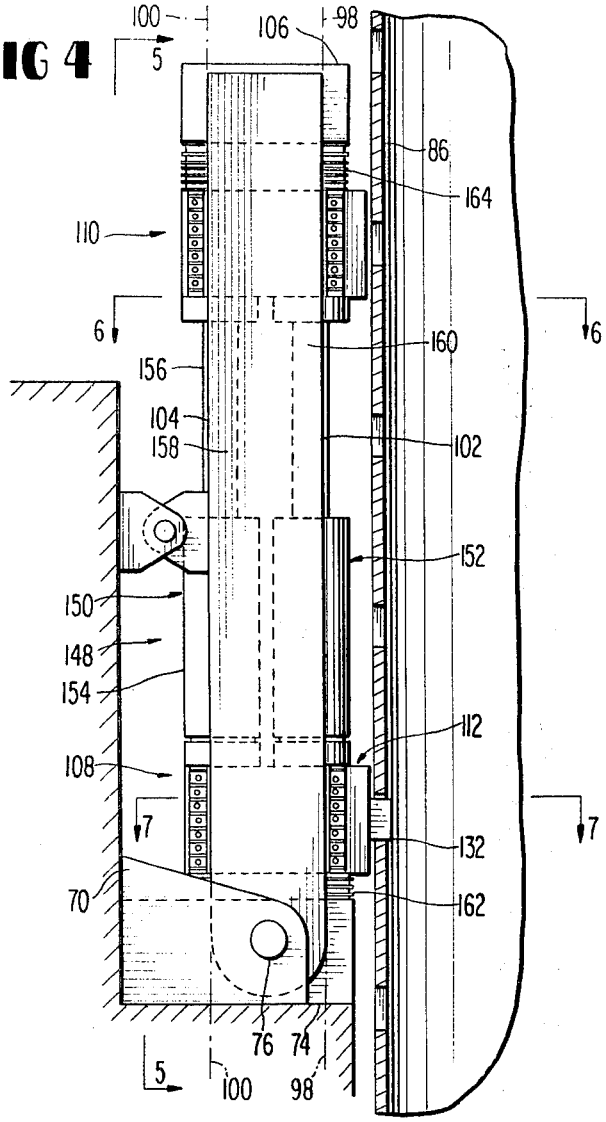
FIG. 4 is a side elevational view of an individual jack-up assembly installed between a leg chord and a deck of the platform.
Figure 5:
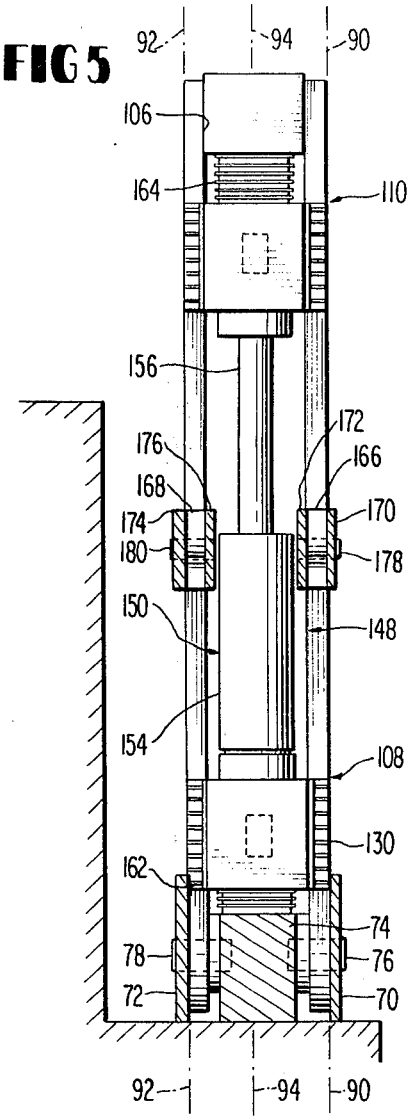
FIG. 5 is a side elevational view taken along section line 5—5 in FIG. 4.
Figure 6:
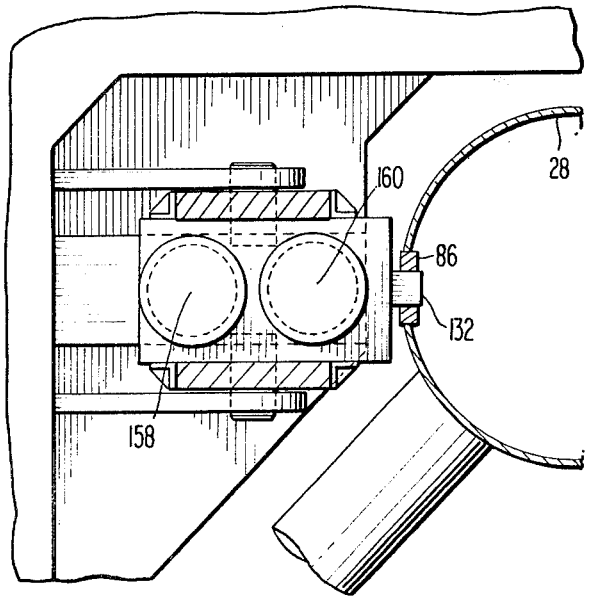
FIG. 6 is a cross-sectional view taken along section line 6—6 in FIG. 4 and discloses a leg chord engaging housing mounted for translation between first and second reaction members of the jack-up assembly.
Figure 7:
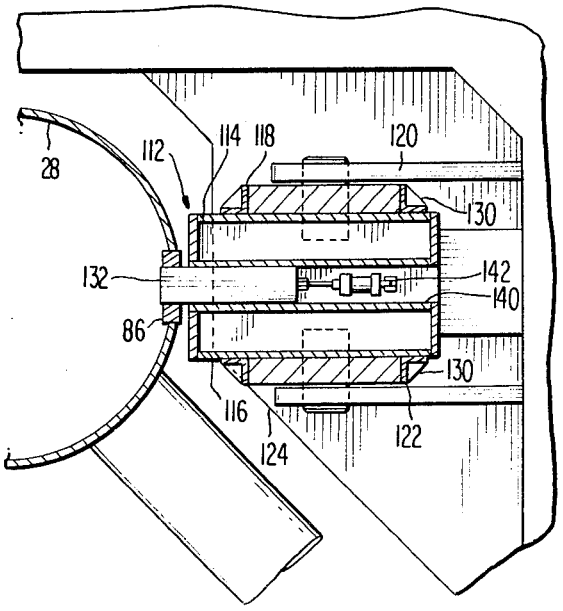
FIG. 7 is a cross-sectional view taken along section line 7—7 in FIG. 4 which has been rotated 180° for ease of illustration and discloses an actuating mechanism for extending and retracting a load bearing pin connection between a lower leg chord engaging assembly and a leg chord of the offshore platform.

Turning now to FIGS. 4–7, it will be seen that each of the leg engaging members 108 and 110 is substantially identical in configuration and operation and is comprised of a housing 112, note particularly FIGS. 4 and 7, which is generally rectangular in configuration. The housing 112 has side walls 114 and 116 which are dimensioned to be intimately received in sliding engagement between the interior wall surfaces of opposing reaction members. Generally channel shaped reaction transmitting members 118, 120, 122 and 124 are connected to the lateral wall surfaces of the housing 112 and are intimately extended in sliding engagement along the edge surfaces of the reaction members across the width thereof. The reaction transmitting members 118–124 may be reinforced by a plurality of triangular webs 130, note FIG. 3, or may be composed of solid triangular bars as desired. In either case, the reaction transmitting members are operably united with respect to the housing 112.

Each of the leg engaging members 108 and 110 is further fitted with a load transmitting bar or pin 132 which is slidingly received within an axial chamber 140 fashioned through the housing. Selective translation of the pin or bar 132 with respect to the housing 112 is achieved by a hydraulic piston and cylinder assembly 142 mounted within the channel 140.

With the foregoing constraint of the housing 112 by the reaction transmitting members along the first and second reaction members, any moment imparted to the housing member through the leg chord and pin will be reacted by engagement of the reaction transmitting members 118–124 across the width of the reaction members 66 and 68. The large section modulus of the reaction members 66 and 68 across the width 82 thereof serves to effectively counter these moments in an efficient manner enabling the weight of each jack-up assembly to be minimized.

Selective translation of the first and second leg engaging members 108 and 110 is achieved by a hydraulic jack assembly 148. The hydraulic jack assembly comprises a pair of hydraulic jack-up units 150 and 152 mounted between the leg engaging members 108 and 110, note FIG. 4. Each hydraulic jack-up unit is composed of a cylinder 154 mounted upon an upper portion of the housing 112 of the first leg engaging member 108. The cylinder carries a conventional internal piston head, not shown, and a piston rod 156 which projects outwardly from the cylinder. The free end of the piston rod is mounted upon a lower portion of housing 112 of the second leg engaging member 110. The hydraulic assemblies 150 and 152 are mounted between the reaction members 66 and 68 in a posture such that central longitudinal axes 158 and 160 thereof respectively lie within the imaginary plane 94 extending between the mutually parallel reaction members 66 and 68.

As will be noted particularly in FIG. 4, the cylinders are oriented such that the full bore of the cylinders are in operation to extend the leg engaging members apart. This push direction of operation, as will be discussed in detail hereinafter, is the load bearing stroke for all of the jacking operations of the deck and leg chord. Accordingly the full bore of the hydraulic cylinders are advantageously utilized during the jack-up operation and the size and weight of the jacking assemblies may be minimized accordingly.

As will be discussed more fully below, the first and second leg engaging members 108 and 110 are selectively jacked into operative abutment with the deck 22 through block 74 or the abutment member 106 respectively. In order to cushion the transmission of loads, first 162 and second 164 bearing pads are connected to the base member and abutment member respectively. Each of these bearing pads are composed of a lamination of steel reinforcing plates and rubber or rubber like cushion members as is known in the art.

As previously noted each of the reaction members 66 and 68 is pivotally and releasably mounted within the deck well 64 by pins 76 and 78. In order to maintain the jack-up assembly 60 in a generally vertical posture, lateral brace means are also provided between the deck and the jack-up assembly. More specifically, lateral brace arms 166 and 168 extend outwardly from a lateral surface of the first and second reaction members 66 and 68 respectively (note FIG. 5). The lateral wall surface of the deck well 64 is provided with parallel mounting arms 170–172 and 174–176 to receive brace arms 166 and 168. Pins 178 and 180 serve to selectively interconnect the brace arms and mounting arms to laterally fix the jack-up assembly in a generally vertical posture with respect to the platform deck.

The foregoing specific discussion has been directed to jack-up apparatus or assembly 60. As previously noted, however, a second jack-up assembly 62 is mounted within each deck well 64. The second jack-up assembly 62 is a mirror image of the first and is operably mounted upon a diametrically opposite side of the leg chord 28. In this regard generally rectangular reaction members 184 and 186 correspond to reaction members 66 and 68. In a similar manner first 188 and second 190 leg engaging assemblies correspond to leg engaging assemblies 108 and 110 respectively. Still further hydraulic jack assembly 192 corresponds to assembly 148. With the foregoing orientation further discussion of the detailed operating elements of assembly 62 may be had by referring to the above description of corresponding elements in assembly 60.

Returning now to FIG. 3, there is disclosed, in phantom representation, an alternate preferred embodiment of bracing the jack-up assemblies 60 and 62 in a generally vertical posture within the deck well 64. More specifically, a first brace assembly 194 is composed of first and second mounting brackets 195 and 196 mounted upon an upper portion of reaction member 66. Identical mounting brackets 198 and 200 are mounted upon the upper portion of reaction member 184 and serve to receive the remote ends of a brace arm 202 which is pinned to the brackets by releasable pins 204 and 206. The brace arm 202 is generally arcuate in configuration in order to extend around the outer periphery of leg chord 28. A mirror image second brace assembly 208 is mounted on the opposite side of the leg chord and acts in cooperation with the first brace assembly to maintain the jack-up assemblies in a vertical posture.

Method of Operation

Turning now to FIGS. 8*a–b* there will be seen a sequence for lowering a leg chord 28 relative to a floating deck 22 in accordance with the invention. As shown in FIG. 8*a*, the jacks 148 and 192 are extended with the upper leg engaging members 110 and 190 extended and the lower leg engaging members 108 and 188 retracted.

Next the jacks are retracted under load and the leg chord 28 and base are lowered with respect to the deck 22. (Note the elevation of points 210 and 212 on leg chord 28 in FIG. 8*a* with respect to the same points in FIG. 8*b*.)

The lower leg engaging members 108 and 188 are then engaged with the leg chord 28, note FIG. 8*b* and the upper leg engaging members 110 and 190 are retracted. The jack-up assemblies 148 and 192 are then extended, under no load, and the process is repeated to jack the leg and underlying base into engagement with the seabed.

Referring now to FIGS. 9*a–b*, note sheet 5, a sequence is depicted for raising the deck 22 above the surface of the body of water. More specifically, and with reference to FIG. 9*a*, the jack-up assemblies 148 and 192 are retracted and the lower leg chord engaging assemblies 148 and 190 are engaged and the upper leg chord engaging assemblies 110 and 190 are retracted. The jacks are then fully extended, under load, which raises the platform deck. (Note the elevation of the deck 22 in FIG. 9*b* with respect to the elevation depicted in FIG. 9*a*.) In the elevated posture, the upper chord engaging members 110 and 190 are engaged with the leg chord and the lower leg chord engaging members 108 and 188 are retracted. The jacks are then retracted, under no load, and the above procedure is repeated.

Utilizing the above procedure the deck 22 is raised to a predetermined elevation relative to sea level so as to minimize the possibility of the deck receiving a direct impact from a statistical storm wave. The deck and leg chords may then be secured together by a separate locking mechanism, welded off or simply unitized by stationary application of the load bearing pins as desired. Drilling, producing or other desired operations are then commenced at the offshore site.

Once the offshore operations are terminated and it is desired to move the platform to another working location, the hull or deck 22 is first lowered into engagement with the surface of the sea. In this connection, and with reference to FIGS. 10*a–b,* note sheet 4, there will be seen a sequence for lowering the deck 22 with respect to a leg chord 28. In the posture depicted in FIG. 10*a* the jack-up assemblies 148 and 192 are extended, the lower leg chord engaging assemblies 108 and 188 are engaged and the upper leg chord engaging assemblies 110 and 190 are retracted. In this posture the platform deck is supported on the chord 28 through the lower leg engaging assemblies 108 and 188, jack-up assemblies 148 and 192, the abutment member and the reaction rails.

The jack assemblies are then retracted, under load, which serves to lower the deck. (Note the position of the deck in FIG. 10*a* with respect to the position in FIG. 10*b.*) Once the deck is lowered, the upper leg chord engaging assemblies 110 and 190 are engaged and the lower leg chord engaging assemblies 108 and 188 are retracted. The jacks are then extended, under no load, and the procedure is repeated to lower the deck onto the surface of the underlying body of water.

Once the deck is floating upon the surface of the body of water, the legs and underlying base may be raised in accordance with the sequence depicted in FIGS. 11*a–b.* More specifically, the jack-up assemblies 148 and 192 are retracted as shown in FIG. 11*a,* the upper leg chord engaging assemblies 110 and 190 are engaged with the leg chord 28 and the lower leg chord engaging assemblies 108 and 188 are retracted. The jack assemblies are then extended, under load, raising the leg chord and the base. (Note the position of leg chord locations 204 and 206 in FIG. 11*a* with respect to the same locations in FIG. 11*b.*)

The lower leg chord engaging assemblies 108 and 188 are then actuated and the upper leg chord engaging assemblies 110 and 190 are retracted. The jack-up assemblies are retracted and the procedure is repeated until the leg chord and base are drawn up into a posture contiguous with the deck for transportation of the platform to another working site.

A specific hydraulic control system has not been depicted or discussed in connection with the above, as one skilled in the art, and familiar with the foregoing functional description, will be able to facilely select the necessary controls to achieve the desired result.

SUMMARY OF MAJOR ADVANTAGES OF THE INVENTION

After reading and understanding the foregoing description of the invention, in conjunction with the drawings, it will be appeciated that several distinct advantages of the subject jack-up platform apparatus are obtained.

Without attempting to set forth all of the desirable features of the instant jack-up apparatus, as specifically and inherently disclosed hereinabove, at least some of the major advantages of the invention includes the unique provision of generally rectangular reaction members mounted upon the deck in a posture contiguous to but spaced from chords of the platform legs. The reaction members serve to efficiently react bending moments across a relatively wide section modulus of the rectangular members. These reaction assemblies enable the subject jack-up apparatus to be advantageously installed without utilizing heavy collars and jack housings to react bending loads and thus the overall weight of the jack-up mechanism is advantageously reduced.

Further mounting the jack-up units between the translatable leg chord engaging members, with the jack cylinders mounted on the lower member, enables the jacks to function under load in a push mode and thus the size efficiency of the jacks may be maximized.

Still further the design and orientation of the reaction members and dual jack-up units enables the unit to be compact and simplified which requires less deck volume than previously known units.

Additionally, the releasable mounting of the reaction members from the base mountings and the lateral braces of the deck wells enable individual jacking units to be fabricated, hydraulically pre-tested and pre-packaged and shipped to a remote yard for final assembly onto a jack-up platform. Additionally in this connection, if an individual jack-up units becomes damaged or worn, it may be facilely replaced and/or serviced without taking the entire platform back into a shipyard. Moreover, the subject removable assemblies may be universal in application and utilized during a jacking operation on one platform and then removed and transported to a subsequent platform(s) for utilization during jack-up operations. Such facile interchangeability not only facilitates repair and/or enhances utilization of the jack-up assemblies but synergistically the working dead weight of the platform may be further by removal of the jack-up assemblies while the platform is on station.

Yet further the provision of the generally rectangular reaction members, abutment member, first and second leg engaging members and dual jack-up assemblies constitute a highly streamlined and ruggadized assembly for performing a jack-up operation which minimizes the number and complexity of parts and potential for unanticipated failure.

In describing the invention, reference has been made to preferred embodiments and illustrative advantages of the invention. Those skilled in the art, however, and familiar with the instant disclosure of the subject invention, may recognize additions, deletions, modifications, substitutions and/or other changes which will fall within the purview of the subject invention and claims.

What is claimed is:

1. Jack-up apparatus operable for effecting relative vertical motion between a leg chord of an offshore platform and a deck of the platform, said jack-up apparatus comprising:

reaction means operable to be connected at one end to the platform deck and operably positioned in a posture contiguous to but spaced from the leg chord of the offshore platform;

abutment means connected to the other end of said reaction means;

first means for engaging with and disengaging from the leg chord of the offshore platform, said first means for engaging being mounted for sliding translation along said reaction means selectively away from and toward the deck of said offshore platform at generally said one end of said reaction means and for operably abutting against the deck portion of said offshore platform;

second means for engaging with and disengaging from the leg chord of the offshore platform, said second means for engaging being mounted for sliding translation along said reaction means selectively away from and toward said abutment means at generally said other end of said reaction means and for operably abutting against said abutment means connected to the other end of said reaction means;

means connected to said reaction means for maintaining the other end of said reaction means in a posture adjacent to the leg chord of the offshore platform; and hydraulic jack means comprising at least one hydraulic piston, piston rod, and cylinder jack assembly mounted between said first and second means for engaging wherein the cylinder of said jack assembly is mounted upon an upper portion of said first means for engaging the leg chord and the free end of the piston of said jack assembly is mounted upon a lower portion of said second means for engaging the leg chord and being operable for translating both of said first and second means for engaging with and disengaging from the leg chord of the offshore platform along said reaction means and between said abutment means and the deck of the offshore platform, wherein selective actuation of said first and second leg chord engaging means and said jack means will function to effect relative vertical motion between the leg chord and the deck of the offshore platform.

2. Jack-up apparatus as defined in claim 1 wherein said reaction means comprises:

a first generally rectangular reaction rail operably mounted with a long dimension thereof extending generally parallel with the leg chord of the offshore platform; and a second generally rectangular reaction rail operably mounted with a long dimension thereof extending generally parallel with the leg chord of the offshore platform and mutually parallel with said first generally rectangular reaction rail.

3. Jack-up apparatus as defined in claim 2 wherein:

each of said first and second generally rectangular reaction rails comprises a generally solid rectangular structure having a height, width and depth and said first and second reaction rails being operably mounted on the platform such that imaginary planes extending through the edges of the reaction rails defining the height and width dimensions thereof lie parallel with an imaginary plane extending through the axis of the adjacent leg chord and being equally spaced between said mutually parallel reaction rails.

4. Jack-up apparatus as defined in claim 3 wherein said first and second leg chord engaging means each comprise:

generally rectangular housing means, said housing means being dimensioned to be received in sliding contact between interior surfaces of said first and second generally rectangular reaction rails;

first and second reaction transmitting means generally vertically extending upon each lateral surface of said housing means and projecting outwardly from said housing means in intimate sliding engagement with opposing surfaces of said generally rectangular reaction rail across the width thereof; and load bearing pin means mounted within said housing means for selective actuation centered along the imaginary plane extending through the axis of the leg chord for selectively engaging the leg chord of the offshore platform.

5. Jack-up apparatus as defined in claim 4 wherein said hydraulic jack means comprises:

first and second hydraulic piston, piston rod and cylinder, jack assemblies wherein the cylinder of each assembly is mounted upon an upper portion of the housing means of said first means for engaging the leg chord and the free end of each piston rod is mounted upon a lower portion of the housing means of said second means for engaging the leg chord.

6. Jack-up apparatus as defined in claim 5 wherein:

said first and second hydraulic jack assemblies each have a central longitudinal axis and said assemblies are mounted upon said first and second housing means in a generally vertical posture between said first and second generally rectangular reaction rails wherein the central longitudinal axes thereof lie upon the imaginary plane extending through the axis of the adjacent leg chord and being equally spaced between said mutually parallel reaction rails.

7. Jack-up apparatus as defined in claim 6 and further comprising:

hydraulic means mounted within each of said housing means for selectively actuating said load bearing pin means into engagement with the leg chord of the offshore platform.

8. Jack-up apparatus as defined in claims 3 or 7 wherein:

said first and second generally rectangular reaction rails are each provided with apertures at said one of the ends thereof for releasable pivotal mounting of the reaction rails to the deck of the offshore platform; and said means for maintaining said first and second generally rectangular reaction rails in a posture adjacent to the leg chord comprises releasable brace means extending between the deck of the platform and said reaction rails.

9. Jack-up apparatus operable for effecting relative vertical motion between a leg chord of a platform and a deck of the platform, said jack-up apparatus comprising:

a first elongate reaction means operable to be mounted at one end to the deck of the platform and extending along and generally parallel to a leg chord of the platform;

a second elongate reaction means operable to be mounted at one end to the deck of the platform and extending along and generally parallel to the leg chord of the platform, said first and second elongate reaction means being spaced apart and operably extending in a parallel posture adjacent to the leg chord of the platform;

abutment means mounted between the other ends of said first and second elongate reaction means;

first frame means mounted for sliding translation between and along said first and second elongate reaction means selectively away from and toward the deck of the platform in a position generally at said one end of said reaction means adjacent the deck of the platform and for operably abutting against a deck portion of said offshore platform;

first leg engaging means connected to and carried by said first frame means for selectively engaging the leg chord of the platform in a posture generally transverse to said first and second elongate reaction means;

second frame means mounted for sliding translation between and along said first and second elongate reaction means selectively away from and toward said abutment means in a position generally at said other end of said reaction means adjacent said abutment means and for operably abutting against said abutment means mounted between the other ends of said first and second elongate reaction means;

second leg engaging means connected to and carried by said second frame means for selectively engaging the leg chord of the platform in a posture generally transverse to said first and second elongate reaction means;

means connected to at least one of said first elongate reaction means and said second elongate reaction means independent of the leg chord for maintaining the other end of said first and second reaction means in a posture adjacent to the leg chord of the offshore platform; and hydraulic jack means comprising at least one piston, piston rod, and cylinder jack assembly connected between and to said first and second frame means mounted between said first and second elongate reaction means wherein the cylinder of said jack assembly is mounted upon an upper portion of said first frame means and the free end of said piston rod is mounted upon a lower portion of said second frame means for slidingly translating said first and second frame means along said reaction means and between the abutment means and the deck of the platform, wherein selective actuation of said first and second leg engaging means and said jack means operably function to selectively effect relative vertical motion between the leg chord and the deck of the platform.

10. Jack-up apparatus as defined in claim 9 wherein said first and second reaction means each comprise:

generally solid rectangular members, having a width, height and depth, operable to be mounted upon the platform deck and having elongate, mutually parallel side surfaces on opposing sides across the width of the rectangular members; and said generally solid rectangular members being operably mounted upon the deck of the platform such that said mutually parallel side surfaces lie in imaginary planes perpendicular to an imaginary plane extending through a central axis of the leg chord and being equally spaced between said first and second elongate reaction means.

11. Jack-up apparatus as defined in claim 10 wherein said first and second frame means each comprise:

first and second mutually parallel reaction transmitting members mounted for intimate sliding translation along said mutually parallel and opposing side surfaces across the width of said first generally solid rectangular member; and third and fourth mutually parallel reaction transmitting members mounted for intimate sliding translation along said mutually parallel and opposing side surfaces across the width of said second generally solid rectangular member, whereby moments imparted to said first or second leg engaging means will be transmitted through said first or second frame means and said first and second, and third and fourth reaction transmitting members and reacted by said first and second generally solid rectangular members across the width thereof.

12. Jack-up apparatus as defined in claim 11 wherein said hydraulic jack means comprises:

a pair of hydraulic jack assemblies mounted to act in parallel unison between said first and second frame means.

13. Jack-up apparatus as defined in claim 12 wherein said pair of hydraulic jack assemblies comprises:

first and second hydraulic piston, piston rod and cylinder assemblies each have a central longitudinal axis and said assemblies being mounted between said first and second frame means and in a generally vertical posture between said first and second rectangular reaction members wherein the central longitudinal axes thereof lie within the imaginary plane extending through the axis of the adjacent leg chord and being equally spaced between said first and second rectangular reaction members, and the cylinder of each jack assembly is mounted upon an upper portion of said first frame means and the free end of each piston rod is mounted upon a lower portion of said second frame means.

14. Jack-up apparatus as defined in claims 11 or 13 wherein:

said first and second generally rectangular members are each provided with pivotal receiving apertures such that said members may be releasably pinned to the deck of the platform; and said first and second generally rectangular members being provided with lateral brace means for releasable connection of said first and second generally rectangular members laterally to the deck of the platform.

* * * * *